US009079696B2

(12) United States Patent
Jordan et al.

(10) Patent No.: US 9,079,696 B2
(45) Date of Patent: Jul. 14, 2015

(54) CONTAINER FOR PERSONAL USE

(71) Applicant: Avon Products, Inc., Suffern, NY (US)

(72) Inventors: Steven Paul Jordan, Buckinghamshire (GB); Amanda Micallef, Northampton (GB)

(73) Assignee: Avon Products, Inc., New York, NY (US)

( * ) Notice: Subject to any disclaimer, the term of this patent is extended or adjusted under 35 U.S.C. 154(b) by 0 days.

(21) Appl. No.: 14/034,728

(22) Filed: Sep. 24, 2013

(65) Prior Publication Data

US 2015/0083686 A1 Mar. 26, 2015

(51) Int. Cl.

| | |
|---|---|
| ***B65D 25/22*** | (2006.01) |
| ***B65D 51/24*** | (2006.01) |
| *B65D 23/00* | (2006.01) |
| *B65D 5/42* | (2006.01) |

(52) U.S. Cl.

CPC ..... *B65D 51/242* (2013.01); *B65D 5/4208* (2013.01); *B65D 23/003* (2013.01); *B65D 25/22* (2013.01)

(58) Field of Classification Search

CPC .... B65D 25/22; B65D 51/242; B65D 23/003; B65D 5/4208

USPC ..... 220/212, 212.5, 729, 751, 482; 215/399; 206/806

See application file for complete search history.

(56) References Cited

U.S. PATENT DOCUMENTS

| | | | | |
|---|---|---|---|---|
| 2,362,523 | A * | 11/1944 | Armstrong, Jr. et al. | 215/399 |
| 2,635,604 | A * | 4/1953 | Fredrickson | 604/403 |
| 4,085,867 | A | 4/1978 | Heller | |
| 4,306,662 | A * | 12/1981 | Sciortino et al. | 215/395 |
| 4,413,741 | A * | 11/1983 | Curchack | 215/399 |
| 4,460,143 | A * | 7/1984 | Ohama | 248/682 |
| 4,500,061 | A | 2/1985 | Nigro | |
| 4,678,102 | A | 7/1987 | Ryder | |
| 4,728,006 | A | 3/1988 | Drobish et al. | |
| 4,756,442 | A | 7/1988 | Haim et al. | |
| 5,186,346 | A * | 2/1993 | Calvert | 220/212.5 |
| D351,479 | S | 10/1994 | Meyer | |
| 5,740,759 | A | 4/1998 | Cummings | |
| 5,749,497 | A | 5/1998 | Davis | |
| 6,065,649 | A | 5/2000 | Scoggins | |
| D457,436 | S | 5/2002 | Weber | |
| 6,766,917 | B1 * | 7/2004 | Blewitt, III | 215/252 |
| 6,808,090 | B2 | 10/2004 | Pedersen | |
| 6,880,714 | B2 | 4/2005 | Blanchester | |
| 7,261,221 | B2 | 8/2007 | Awbrey et al. | |
| 2005/0250658 | A1 | 11/2005 | Putman et al. | |
| 2007/0114246 | A1 | 5/2007 | Awbrey et al. | |
| 2011/0011901 | A1 * | 1/2011 | Gouldson | 223/85 |

FOREIGN PATENT DOCUMENTS

| | | | |
|---|---|---|---|
| EP | 0506259 | A1 | 9/1992 |
| GB | 2098958 | B | 9/1984 |
| WO | 2012-062569 | A1 | 5/2012 |

OTHER PUBLICATIONS

"Avon Skin So Soft" website screen capture from www.amazon-cam—last accessed Sep. 23, 2013.

"Duschdas Shower Gell for Men 250ml shower gel" website screen capture from www.amazon.com—last accessed Sep. 23, 2013.

"250ml Hooked Cap Shower Gel" website screen capture from www.mhplastics.com—last accessed Sep. 23, 2013.

Radox Men deep clean shower scrub (dated Oct. 27, 2010) website screen capture from www.apetoman.com—last accessed Sep. 23, 2013.

"Radox Showerfresh Hair & Body Gel for Men" (dated Jan. 29, 2001) website screen capture from http://www.ciao.com.uk—last accessed Sep. 20, 2013.

* cited by examiner

*Primary Examiner* — Fenn Mathew
*Assistant Examiner* — James N Smalley
(74) *Attorney, Agent, or Firm* — David M. Joyal; Joan M. McGillycuddy

(57) ABSTRACT

Containers with hooks are provided including those that hold personal care products such as shampoo or shower gel, and which comprise a cap at each end of an elongated container, the cap at one end comprising an articulating hook attached to the cap by a film hinge. The articulating hook, in the open configuration, allows the container to hang from an object such as a shower rod.

4 Claims, 5 Drawing Sheets

CONTAINER FOR PERSONAL USE

FIELD OF THE INVENTION

The present application generally relates to a container that holds personal care products such as shower gel or shampoo. The container may comprise a cap at one end of an elongated container, the cap comprising an articulating hook attached to the cap, such as by a film hinge. The articulating hook may be moved to an open configuration, allowing the container to hang from an object such as a shower rod.

BACKGROUND

There is typically limited space in a shower for placing bottle of shampoo, conditioner, shower gel, and the like. Some personal care products, such as Avon Products' Skin So Soft® shower gel, are packaged in bottles having a hook for hanging the bottle on a shower rod or the like. Other products comprise a hook for hanging the bottle, as described in WO2012/062569, the disclosure of which is hereby incorporated by reference.

There is a continuing need in the art for improved functional designs for containers that hold personal care products.

SUMMARY OF THE INVENTION

In accordance with the foregoing objectives and others, the present invention provides containers for personal care products that comprise, on the same end, an articulating hook for hanging the container, and a flat surface for standing the container. The inventive container generally comprises an elongated container having a first end and a second end. The first end of the container may have a means for dispensing a liquid product from within the container. The second end of the container also may have a cap attached to it for example by a snap fit, such that the cap ideally forms a substantially continuous outer contour with the container. The second end cap may also have a flat end face that is configured to allow the bottle to stand on end. The cap also comprises an articulating hook attached to the cap, for example, by a film hinge. The articulating hook is movable between a closed configuration and an open configuration. The hook, together with the cap, typically forms a substantially continuous outer contour of the bottle when in a closed configuration, and it is capable of hanging onto a shower rod or other like structure when in the open configuration.

In certain embodiments, the hook comprises a generally U-shaped plastic strip and may further have an L-shaped cross section across at least a portion of the strip. Such a hook may be capable of supporting up to ten times the weight of the container in a filled condition with water. The hook may be capable of straightening at an applied force over about 20 N without failure of the film hinge and without removing the cap from the bottle.

In some embodiments, the first end of said container also has a flat end face configured to allow the bottle to stand on end.

These and other aspects of the invention will be better understood by reading the following detailed description and appended claims.

BRIEF DESCRIPTION OF THE DRAWINGS

Various embodiments of the present invention are illustrated by way of example and are not limited by the following figures.

DETAILED DESCRIPTION

All terms used herein are intended to have their ordinary meaning in the art unless otherwise provided.

Figure 1:
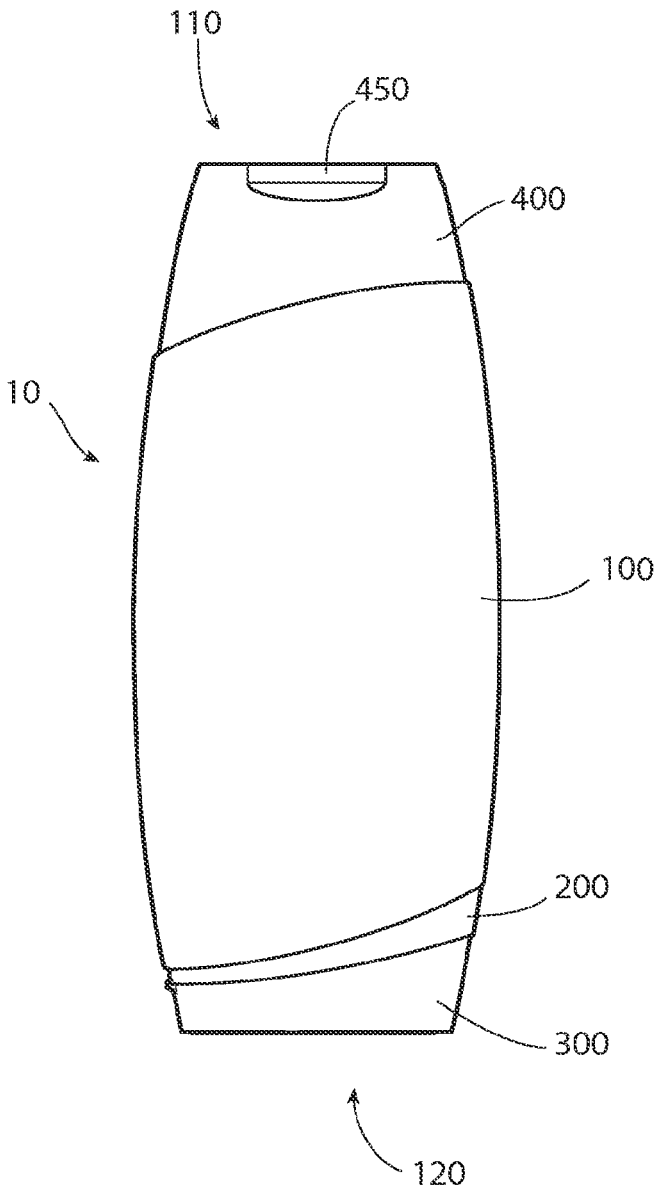
FIG. 1 shows a front view of a container according to one embodiment of the invention.

Referring to FIG. 1, an exemplary container 10 according to the invention is illustrated. The bottle as shown is an elongated hollow body 100 that has a first end 110 and a second end 120, and defines an interior space for holding and dispensing products, such as personal care products.

The materials to be held and dispensed by the container are not particularly limited, and include any kind of liquid, gel, paste, emulsion, suspension and the like, that can be held in the container, and preferably intended for contact with the body. As used herein, the term liquid is intended to include very viscous materials, including non-Newtonian liquids having very high initial viscosities, as well as gels and other materials. In another embodiment, the material is shampoo, conditioner, body wash, lotion, cream, liquid soap, cosmetics, shaving gel or shaving cream, mousse, cleanser, sunscreen, personal care product, cleaning product, or detergent. Of course, the interior is not limited to these product forms, and includes any liquid, gel, lotion, paste cream, emulsion, or the like. Products for pet care are also contemplated.

In one embodiment shown in FIG. 1, the first end 110 of the container has a cap 400 mounted onto the end of the body 100, the cap 400 comprising a means for dispensing the material from the container. The means for dispensing the material may comprise any suitable structure, including a toggle cap having a valve, a flip-top covering an aperture or orifice through which the material may be poured, squeezed or otherwise dispensed, a pull top valve (of the type commonly found in dish-washing liquid bottles), a nozzle, a pump, a push pump, a vent, a channel, a mouth, a tube, and the like. A pump mechanism of the general type described in U.S. Pat. No. 4,930,670, hereby incorporated by reference herein, is also suitable.

In the embodiment shown in FIG. 1, a flip-top 450 is included on the cap 400, illustrated in a closed configuration, but that is capable of being flipped to an open configuration by the user. The flip-top 450 in the closed position covers an orifice, such as a circular aperture 470 (shown in FIG. 10). The flip-top may also have a sealing plug 460 that seals aperture 470 (shown in FIG. 10). The configuration of the flip top is not particularly important. For example, in one embodiment, the flip top forms the entire end portion of cap 400. However, in another embodiment, the flip top may be generally flat so that the container can be stood on the end comprising cap 400. In use, the material may be dispensed from the container by squeezing the walls of the flexible container to force the liquid composition through the orifice.

The cap 400 on the first end 110 of the container generally forms a substantially continuous outer contour with the body 100 as shown in FIG. 1. The cap 400 may be snap fit onto the body 100 of the container according to known methods. Preferably, end 110 has a flat or substantially flat end face by which is meant that the container can be stood on that end.

In the embodiment shown in FIG. 1, there is a cap 400 on end 110. However, it will be recognized that many configurations are possible for sealing the first end 110 of the container; they do not require a cap fitting on that end, or over the entire end. For example, end 110 may comprise a threaded neck over which a screw cap is secured to close the opening in the neck. The material can be dispensed through the opening in the neck when the cap is removed, or may be dispensed by using a pump that is disposed through the cap (e.g., of the type commonly used for hand soaps), a toggle valve on the cap, etc.

In the embodiment shown in FIG. 1, the second end 120 of the container has a cap 200 that is attached to the body 100 by a snap fit, and the cap generally forms a substantially continuous outer contour with the body 100. In another embodiment, the cap 200 has a flat or substantially flat end face, by which is meant that the container can be stood on that end when the hook is in closed configuration.

In one embodiment, both the cap 400 on the first end 110 and the cap 200 on the second end 120 each have flat or substantially flat end faces configured to allow the container to stand on either end.

The cap 200 comprises an articulating hook 300, illustrated in FIG. 1 in a closed configuration. The hook 300 is movable between a closed configuration and an open configuration (shown in FIG. 4).

Figure 2:
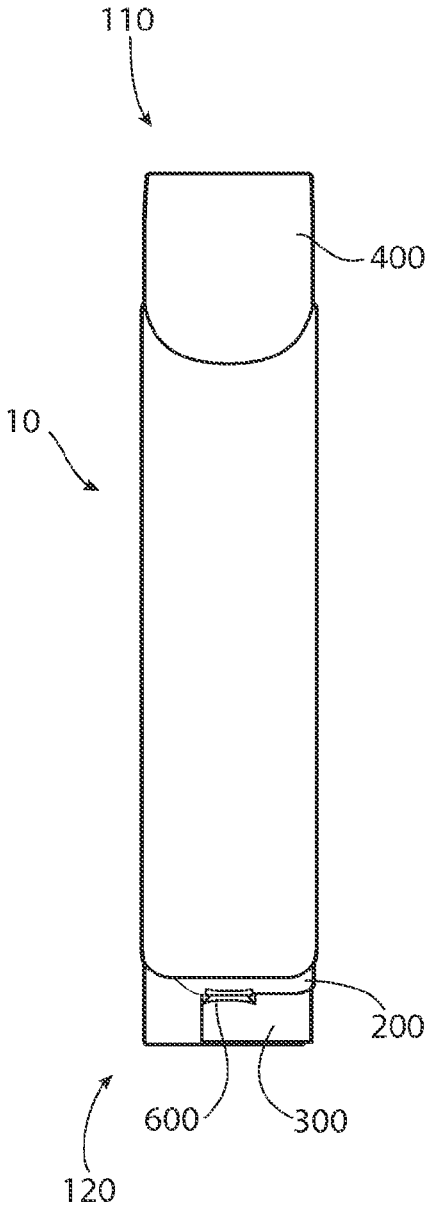
FIG. 2 is a side view of the container illustrated in FIG. 1.
Figure 3:
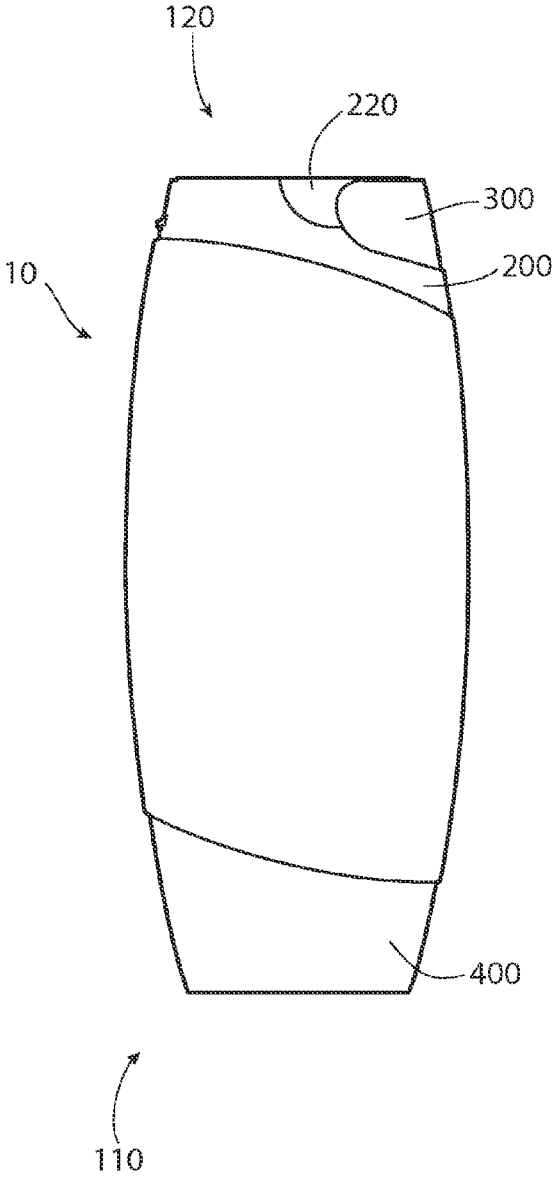
FIG. 3 is a back, upside down view of the container of FIG. 1.

Referring to FIG. 2, the hook 300 is attached to the cap 200 by hinge means. In the case of FIG. 2, a film hinge 600 is shown. In the embodiment shown, the hook 300 comprises a generally U-shaped strip (e.g., made of plastic) that wraps around the cap 200 on the second end 120 of the container. The hook 300, together with the cap 200, can form a substantially continuous outer contour of the container when in a closed configuration, as shown in FIGS. 1-3. Also, hook 300 extends to the end of the container and is flush with the face of cap 400 so that it does not interfere with the container standing on that end where the hook is in the closed configuration.

Figure 4:
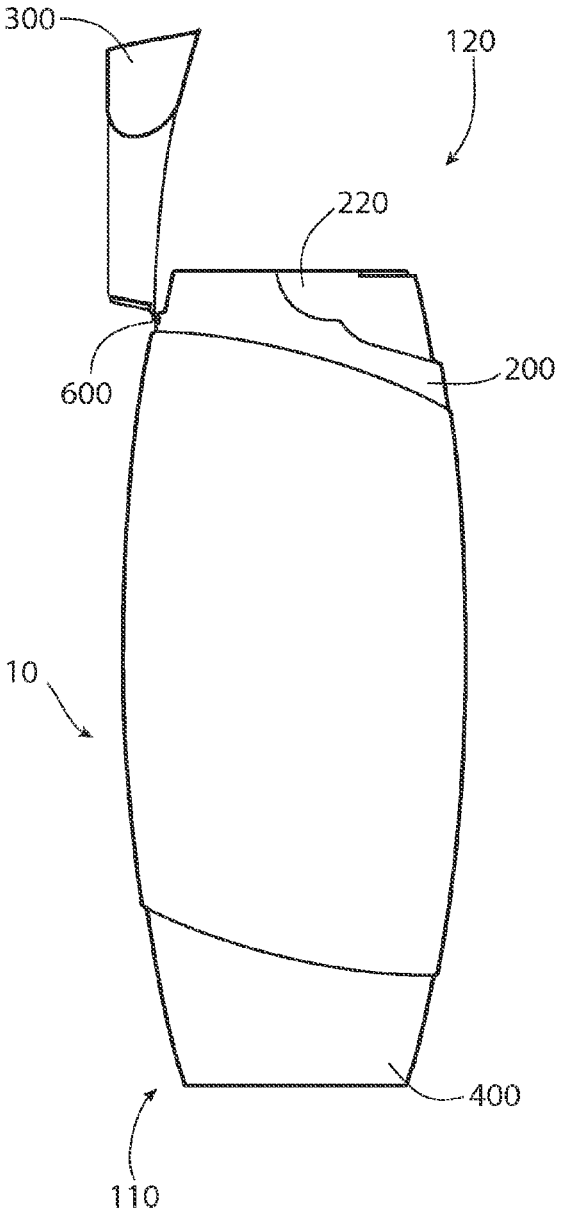
FIG. 4 illustrates the container shown in FIG. 3 with the hinge in an open configuration.

FIG. 3 illustrates an exemplary container 10, standing on the cap 400 of the first end 110 with hook 300 in a closed position. As shown, the tail of the hook 300 is in a closed configuration, wrapped around the cap 200. In one embodiment, a slight depression 220 in the cap 200 of the container allows a user to slide a finger beneath the tail of the hook so that it may pop the hook off of the cap 200. FIG. 4 illustrates the same perspective as in FIG. 3, but shows the hook 300 in an open position after it has been popped off of the cap 200 and lifted vertically away from the cap 200.

Figure 5:
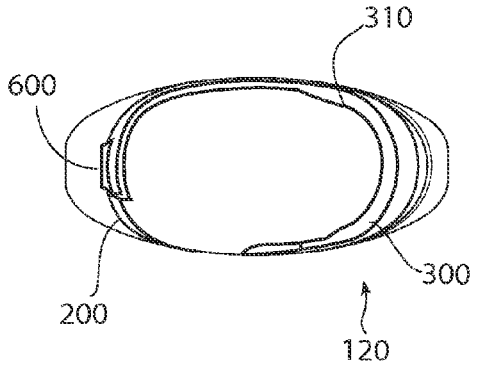
FIG. 5 is a bottom perspective view of the second end of the container of FIG. 1, showing the articulating hook in a closed configuration.
Figure 6:
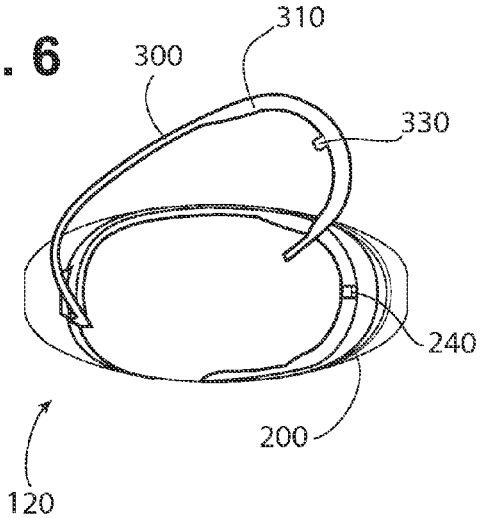
FIG. 6 shows the bottom perspective view of the second end of the exemplary container shown in FIG. 5, with the hook in an open configuration; showing the ledge 310 and protuberance 330 which snaps into socket 240.

Referring to FIG. 5, a bottom view of the exemplary container is shown, which illustrates the bottom of the second end 120 of the container having a cap with a flat end face, and the hook 300 in a closed configuration. A ledge 310 on the hook 300 is also illustrated in the embodiment shown. FIG. 6 shows the same bottom view as FIG. 5, but shows the hook 300 in an open configuration, after it partially has been lifted vertically away from the cap 200, and then pulled horizontally away from the container. Also shown is a small protrusion 330 (e.g., of plastic) from the U-shaped hook 300 that snaps into an opening 240 of complementary geometry. When the protrusion 330 snaps into the opening 240, the hook 300 is secured or locked in place, in the closed configuration.

Figure 7:
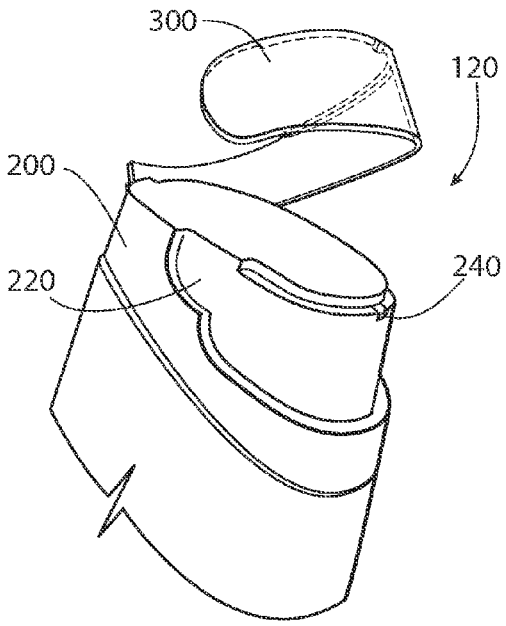
FIG. 7 is a perspective view of the container illustrated in FIG. 1, with the hook in a partially open configuration.
Figure 8:
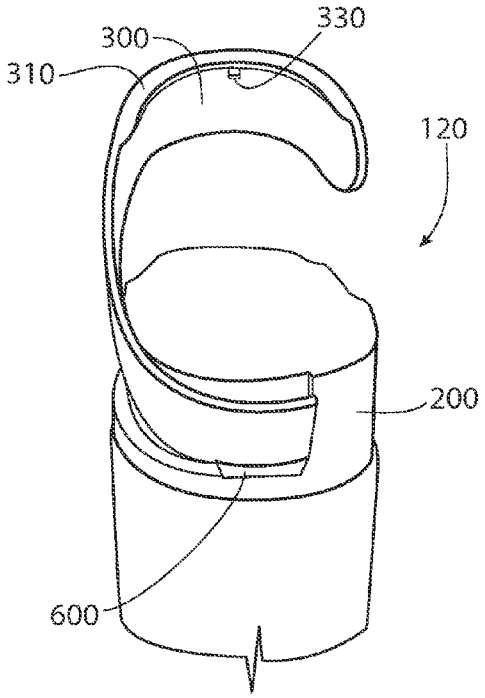
FIG. 8 is a side view of the container shown in FIG. 7, showing the ledge 310 on hook 300.

FIG. 7 shows a perspective view of the second end 120 of the container, with the hook 300 in an open configuration after it has been lifted vertically away from the cap 200. As shown, the hook 300 fits snugly into a recess in the cap such that when the hook is closed, it, together with the cap, forms a substantially continuous outer surface (except for depression 220). Referring to FIG. 8, the second end 120 of the container is shown with the hook 300 in an open configuration as in FIG. 7, but from a side view, further illustrating the ledge 310 that spans a portion of the hook 300. The ledge 310 imparts structural integrity to the hook 300 and diminishes the ability of the hook to straighten. Thus, under normal loads, including the weight of the liquid inside the container or light pulling on the container, the hook does not straighten. The angle formed between ledge 310 and the vertical portion of hook 300 is shown in FIG. 9.

Figure 9:
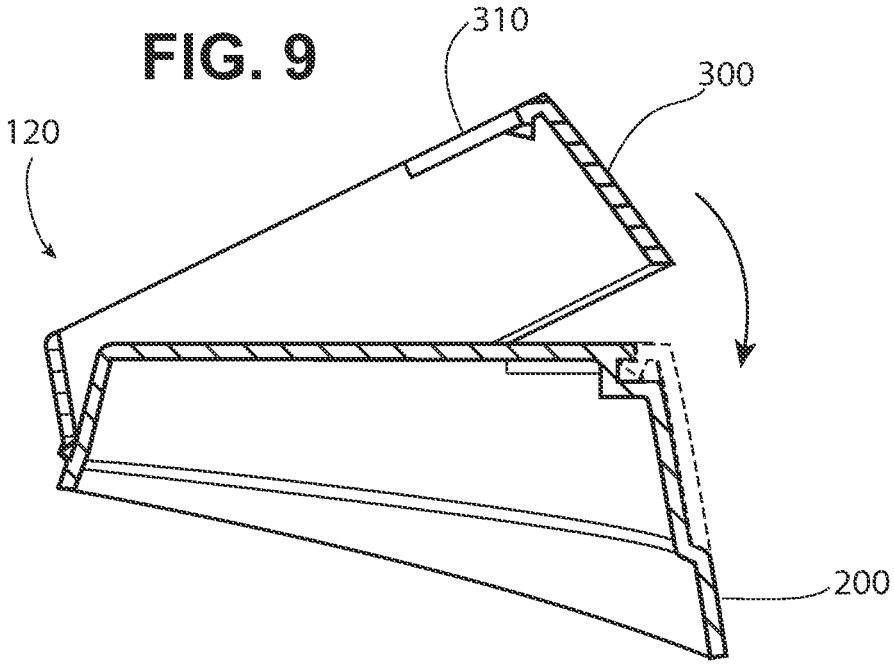
FIG. 9 is a cross-sectional view of the hook and cap showing the angle formed between ledge 310 and the upright portion of hook 300.

Referring to FIG. 9, a cross-sectional view of the U-shaped hook 300 is shown, which illustrates the L-shaped cross section across at least a portion of the hook, which forms an angle between about 90° and about 135°, preferably between about 90° and about 110°.

Figure 10:
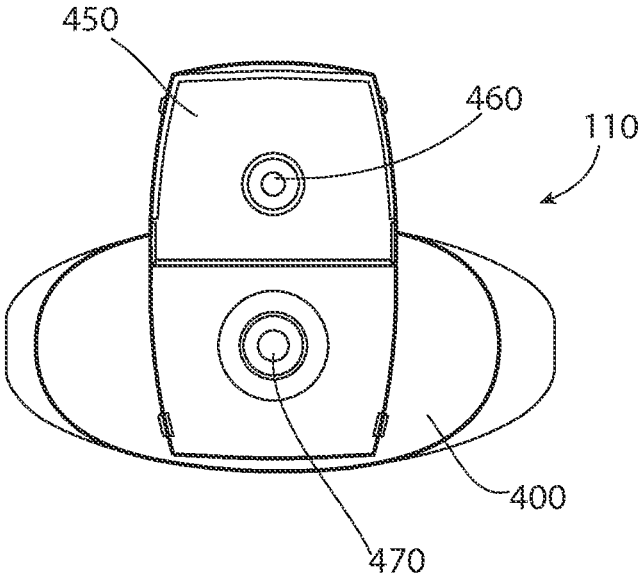
FIG. 10 is a top perspective view of the first end of the container illustrated in FIG. 1, with a flip-top 450 in an open configuration showing orifice 470 for dispensing product.

FIG. 10 shows a flip-top 450 on end 110, illustrated in an open configuration, revealing an orifice 470 from which the material may be squeezed. The flip-top may also have a sealing plug 460 that seals aperture 470.

Figure 11:
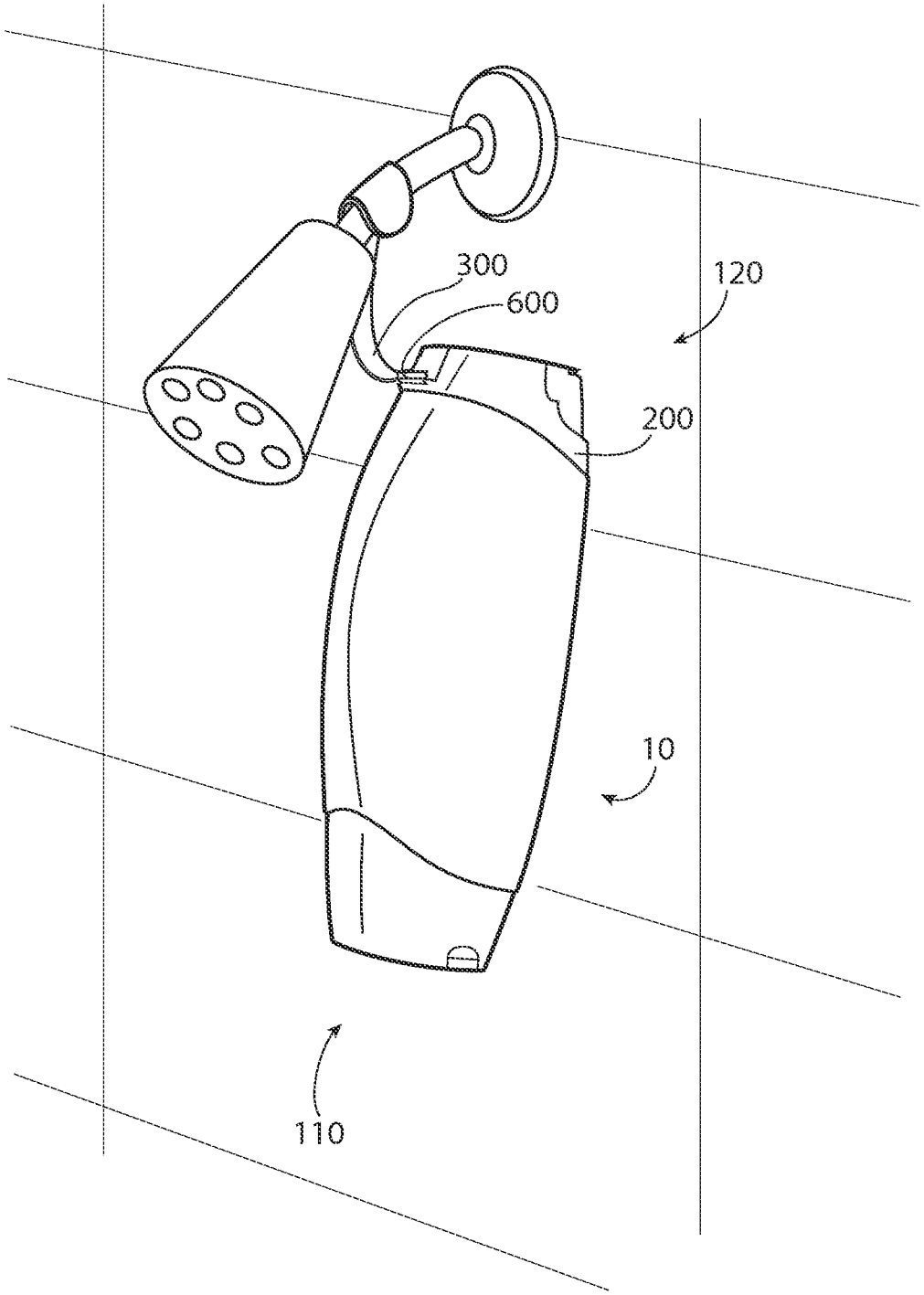
FIG. 11 illustrates an exemplary container hanging from a shower fixture.

In the embodiment shown in FIG. 11, when the hook 300 is in the open configuration, it can hang from any suitable object, such as a shower rod or shower fixture as illustrated. When the hook 300 is in the open configuration and hanging from an object, it is capable of supporting up to ten times the weight of the container to which it is attached, in a filled condition with water. The hook 300 is capable of straightening at an applied force over about 20 N without failure of the film hinge 600 and without removing the cap 200 from the body 100.

The container 10 can be made of any suitable material, for example, plastic (such as polyethylene or polypropylene), glass, metal, laminated material, or any combination thereof. Suitable plastics include, for example, polyolefins, such as polyethylene, polypropylene, polystyrene, polyvinyl chloride, polylactic acid, and polyethylene terephthalate.

The plastic may be molded using a variety of conventional techniques, such as molding, blow molding, extrusion blow molding, injection molding, stretch blow molding, compression molding call, and injection blow molding. Although the container will typically be a solid structure, it may also be flexible in one or more dimensions.

The invention having been described by the forgoing description of the another embodiment, it will be understood that the skilled artisan may make modifications and variations of these embodiments without departing from the spirit or scope of the invention as set forth in the following claims.

All patent and non-patent literature discussed above is hereby incorporated by reference in its entirety for all purposes.

We claim:

1. A bottle for a personal care product comprising:

an elongated container having a first end and a second end;

the first end having a means for dispensing a liquid product from within said container;

the second end having a cap attached to said container by a snap fit, wherein said cap forms a substantially continuous outer contour with the container and has a flat end face configured to allow the bottle to stand on end when an articulating hook attached to said cap by a film hinge is in a closed configuration; wherein the articulating hook comprises a generally U-shaped plastic strip having an L-shaped cross section across at least a portion of said strip and is moveable between the closed configuration and an open configuration and is movable both vertically and horizontally with respect to the container; wherein the hook extends to the second end of the container and is flush with the end face of the cap so that it does not interfere with the container standing on the second end when the hook is in a closed configuration, and wherein the hook wraps around the outer contour of the cap such that the hook, together with the cap, forms a substantially continuous outer contour of the bottle when in a closed configuration and is capable of hanging onto a shower rod when in the open configuration.

2. The bottle according to claim 1, wherein said hook is capable of supporting up to ten times the weight of the container in a filled condition with water.

3. The bottle according to claim 1, wherein said hook is capable of straightening at an applied force over about 20 N without failure of the film hinge and without removing the cap from the bottle.

4. The bottle according to claim 1 wherein the first end of said container has a flat end face configured to allow the bottle to stand on end.

* * * * *